US006108975A

United States Patent [19]

Bailey

[11] Patent Number: 6,108,975

[45] Date of Patent: Aug. 29, 2000

[54] AUTOMATIC DOOR OPERATOR

[75] Inventor: Kevin L. Bailey, Norridge, Ill.

[73] Assignee: NT Dor-O-Matic Inc., Harwood Heights, Ill.

[21] Appl. No.: 09/322,275

[22] Filed: May 28, 1999

Related U.S. Application Data

[60] Provisional application No. 60/086,970, May 28, 1998.

[51] Int. Cl.[7] ..... E05F 15/02

[52] U.S. Cl. ..... 49/334; 74/89.14

[58] Field of Search ..... 49/339, 340, 341, 49/333, 334, 335, 336; 74/89.14

[56] References Cited

U.S. PATENT DOCUMENTS

| | | | |
|---|---|---|---|
| 3,874,117 | 4/1975 | Boehm | 49/264 |
| 3,981,203 | 9/1976 | Williams | 74/25 |
| 4,045,914 | 9/1977 | Catlett | 49/334 |
| 4,220,051 | 9/1980 | Catlett | 74/89.15 |
| 4,501,090 | 2/1985 | Yoshida et al. | 49/264 |
| 4,727,679 | 3/1988 | Kornbrekke et al. | 49/138 |
| 4,970,826 | 11/1990 | Richmond et al. | 49/139 |
| 5,063,316 | 11/1991 | E-Ming | 74/89.14 X |
| 5,332,279 | 7/1994 | Golemis et al. | 296/146.4 |
| 5,513,467 | 5/1996 | Current et al. | 49/340 |
| 5,680,728 | 10/1997 | Moy | 49/324 |
| 5,687,507 | 11/1997 | Beran | 49/339 X |

*Primary Examiner*—Jerry Redman
*Attorney, Agent, or Firm*—Michael H. Minns

[57] ABSTRACT

An automatic door operator for swing doors which uses a worm gear transmission to connect the motor to a belt and pulley which in turn is connected to a spur gear and drive gear. The door arm of the swing door is connected to a double-ended shaft which is part of the drive gear. A rack and pinion gear and spring are used to provide the closing force to the door arm. The motor is mounted over the spring and the belt and pulleys are located alongside the motor which results in a compact non-handed design.

8 Claims, 2 Drawing Sheets

AUTOMATIC DOOR OPERATOR

This application claims the benefit under 35 U.S.C. § 119 (e) of the U.S. provisional application No. 60/086,970, filed May 28, 1998.

BACKGROUND OF THE INVENTION

This invention relates generally to automatic door operators and more particularly to swing door automatic door operators.

Prior art automatic door operators for swing doors have used many gears for transmission of power from a motor to the door. This raises the cost of the door operator and requires more space to house the many gears. With a large gear assembly, it is not always possible to have a compact enough package to make the operator non-handed.

The foregoing illustrates limitations known to exist in present automatic door operators. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a door operator for a swing door having a pivotable door arm attached thereto, the door operator comprising: a motor; and a gear assembly, the pivotable door arm being attached to the gear assembly, the gear assembly comprising a worm gear transmission connected to the motor.

In a second aspect of the present invention, this is accomplished by providing a door operator for a swing door having a pivotable door arm attached thereto, the door operator comprising: a motor; and a gear assembly comprising a pulley and belt drive connected to the motor; and a spur gear assembly driven by the belt, the pivotable door arm being attached to the spur gear assembly, the pulley and belt drive being positioned alongside the motor.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 4:
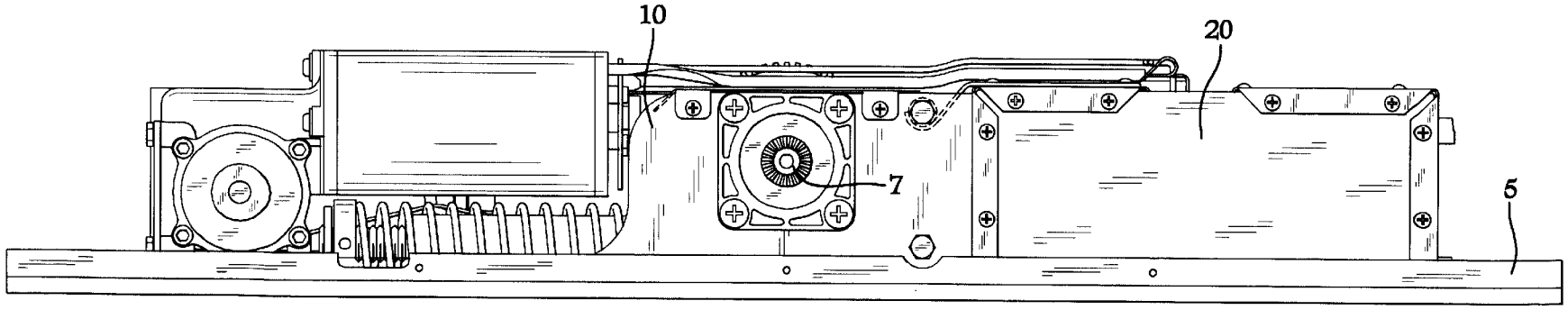
FIG. 4 is a side view of the automatic door operator showing the motor and gear assembly and electronics control module.

FIG. 4 shows an automatic door operator including a motor and gear assembly 10 and electronics control module 20 mounted on a housing or mounting bracket 5. A door arm assembly (not shown) is attached (at 7) to a double-ended shaft 43 of a bearing, pinion and gear assembly 42, 44 and 46. For a push type installation, the automatic door operator is mounted with the motor and gear assembly 10 towards the hinge side of the door. For a left hand door, the door arm is attached to the end 7 of the double-ended shaft 43 numbered in FIGS. 2 and 4. For a right hand door, the door arm is attached to the end 7 of the double-ended shaft 43 numbered in FIG. 1. For a pull type installation, the automatic door operator is mounted with the motor and gear assembly 10 towards the lock side of the door. Preferably, the motor and gear assembly 10 and electronics control module 20 are positioned such that the double-ended shaft 43 is positioned equidistant from the ends of mounting bracket 5. The use of the double-ended shaft 43 for attachment of the door arm to either side of the automatic door operator and the central positioning of the double-ended shaft makes this automatic door operator non-handed. The same unit can be used for either right hand doors or left hand doors by reversing the mounting of the automatic door operator.

Figure 1:
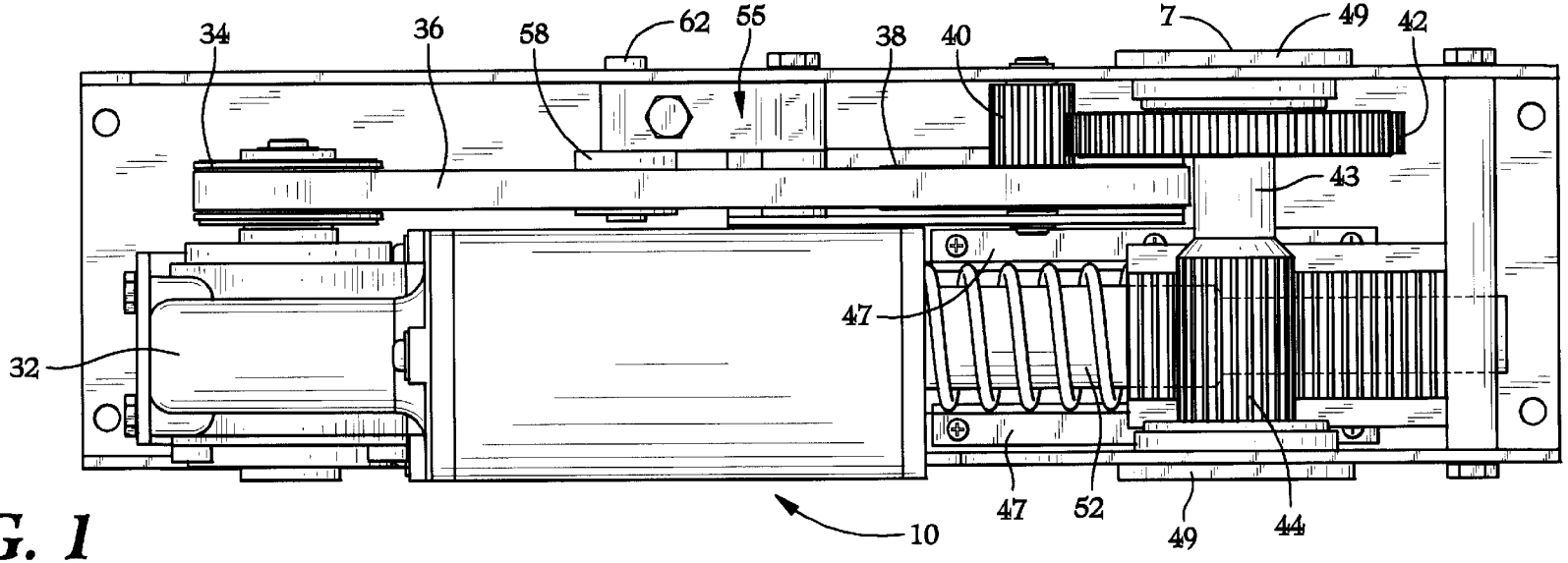
FIG. 1 is a front view of the motor and gear assembly of an automatic door operator for use with swing doors.
Figure 2:
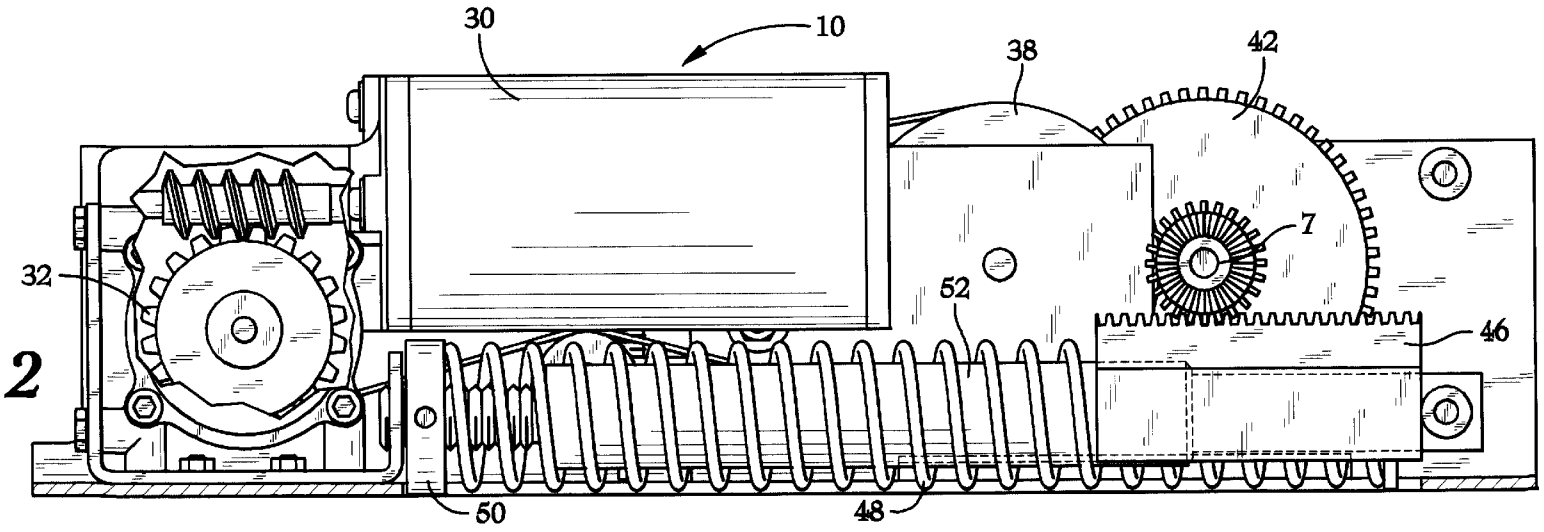
FIG. 2 is a side view of the motor and gear assembly shown in FIG. 1 with portions of the housing removed.
Figure 3:
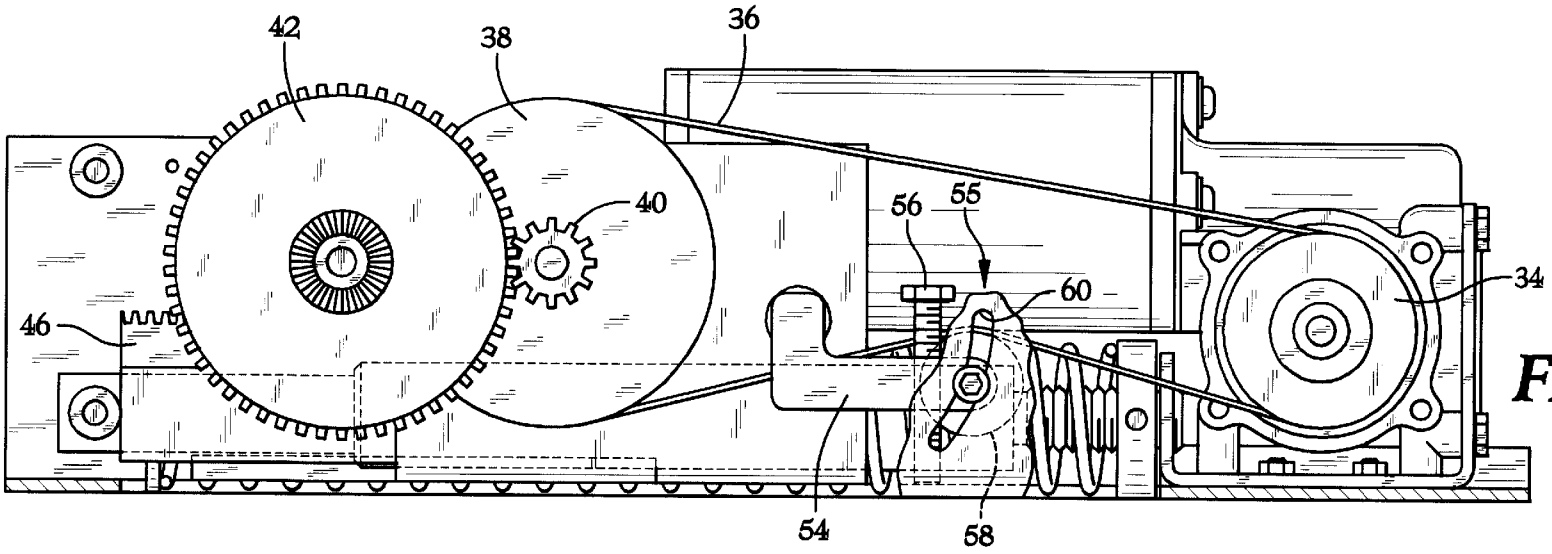
FIG. 3 is an opposite side view of the motor and gear assembly shown in FIG. 1 with portions of the housing removed.

FIGS. 1 through 3 shows the details of the motor and gear assembly 10. A motor, preferably a 30V DC motor, with a right angle drive transmission 32 attached to the motor drive shaft. Preferably, the right angle drive transmission is a worm gear transmission as shown in FIG. 2. The preferred gear ratio of the worm gear transmission is 10:1. A belt and pulley transmission consisting of a first pulley 34, belt 36 and second pulley 38, is attached to the output shaft of the worm gear transmission. The pulleys 34, 38 preferably are toothed pulleys and the belt 36 is also preferably a toothed belt.

The second pulley 38 has a spur gear 40 attached thereto. The spur gear 40 drives drive gear 42 which along with pinion gear 44 are attached to the double-ended shaft 43. Drive gear 42, pinion gear 44 along with the double-ended shaft 43 and two bearing housings 49 which support the double-ended shaft 43, rotatably drive the door arm. The overall gear ratio of the motor 30, worm gear transmission 32, belt and pulleys 36, 34, 38, spur gear 40 and drive gear 42 is about 81:1.

In the preferred embodiment, the automatic door operator uses the motor 30 to drive the door arm and attached swing door to an open position and uses a rack and pinion and closing spring to drive the door arm and swing door to a closed position. A rack 46, in geared connection with pinion gear 44, is slidably mounted on spring shaft 52. Positioned about the spring shaft 52 is spring 48 which provides the force to move the rack 46 towards a closed position (to the right in FIGS. 1 and 2), thereby also moving the door arm and swing door to the closed position. One end of the spring shaft 52 is threaded and has a spring adjuster nut 50 attached thereto. The spring adjuster nut 50 allows adjustment of the spring force applied by the spring 48 to the rack 46. Two rack slides 47 are provided under the rack 46. These slides 47 are typically formed from a friction reducing material, such as Teflon®.

FIG. 3 shows the pulley and belt arrangement along with a belt tensioner 55. The belt tensioner 55 includes a pivotably mounted tensioner bracket 54 with an adjusting screw 56 threadedly attached thereto. At the end of the tensioner bracket 54 remote from the pivotably mounting, a rotatable tension pulley 58 is attached by screw 62. The head of screw 62 engages an arcuate slot 60. Adjustment of the adjusting screw 56 causes the tension pulley 58 to move closer to or further away from the belt 36 to adjust the tension on the belt 36.

Also, in the preferred embodiment, the motor 30 is position over spring 48 with the worm gear transmission 32 at the end of the motor 30 away from the rack and pinion gear 46, 44. The belt and pulleys 36, 34, 38 are then positioned alongside the motor 30. This results is a small compact motor and gear assembly 10 which when mounted in housing 5 with the electronics control module 20 permits the double-ended shaft to be positioned in the middle of the housing 5 which results in the automatic door operator being non-handed.

In operation, to open the swing door, the motor 30 is turned on, typically clockwise rotation when viewed from the end opposite the worm gear transmission 32, which causes the double-sided shaft 43 to rotate, moving the door arm towards the open position and moving the rack 46 to left in FIG. 2. The motor 30 is ramped up to a constant opening voltage to about 75° open. Just before 75°, the voltage is ramped down to a backcheck voltage. The motor 30 is then turned off momentarily followed by a shorting of the motor 30. All of this provides a dynamic braking of the door to slow down the door. Then the backcheck voltage is re-applied until the door is 90° open. A final, lower voltage is applied to hold the door open. To close the door, this lower door hold voltage is removed allowing the spring 48 to close the door. A resistance load is applied across the motor to provide for controlled dynamic braking to control the door closing speed. At about 15° to 10°, the resistance load is removed and the motor is shorted. Since the motor is a DC motor, the motor voltage is preferably controlled by Pulse Width Modulation.

What is claimed is:

1. A door operator for a swing door, the door operator comprising:

a pivotable door arm adapted to be attached to the swing door;

a motor; and a gear assembly, the pivotable door arm being attached to the gear assembly, the gear assembly comprising a worm gear transmission connected to the motor; a pulley and belt drive connected to the transmission; and a spur sear assembly driven by the belt, the pivotable door arm being attached to the spur gear assembly, the pulley and belt drive being positioned alongside the motor and the motor being positioned between the transmission and the sour gear assembly.

2. A door operator for a swing door, the door operator comprising:

a pivotable door arm adapted to be attached to the swing door;

a motor;

a gear assembly, the pivotable door arm being attached to the gear assembly, the gear assembly comprising a worm gear transmission connected to the motor;

a rack and pinion gear connected to the gear assembly, the rack being moveable between an open position and a closed position; and a compression spring biasing the rack to the closed position.

3. The door operator according to claim 2, wherein the motor is positioned adjacent and above the compression spring.

4. A door operator for a swing door, the door operator comprising:

a pivotable door arm adapted to be attached to the swing door;

a motor;

a gear assembly, the pivotable door arm being attached to the gear assembly, the sear assembly comprising a worm gear transmission connected to the motor;

a housing, the motor and gear assembly being positioned proximate a first end of the housing; and an electronics control module being positioned adjacent the motor and gear assembly and being positioned proximate end of the housing, the pivotable door arm attachment to the gear assembly being positioned equidistant from the first and second ends of the housing.

5. A door operator for a swing door, the door operator comprising:

a pivotable door arm adapted to be attached to the swing door;

a motor;

a gear assembly comprising a pulley and belt drive connected by a right angle transmission to the motor; and a spur gear assembly driven by the belt, the pivotable door arm being attached to the spur gear assembly, the pulley and belt drive being positioned alongside the motors;

a rack and pinion gear connected to the sear assembly, the rack being movable between an open position and a closed position; and a compression spring biasing the rack to the closed position, the motor being positioned adjacent and above the compression spring.

6. A door operator for a swing door, the door operator comprising:

a pivotable door arm adapted to be attached to the swing door;

a motor;

a gear assembly comprising a worm gear transmission connected to the motor;

a pulley and belt drive connected to the transmission;

a spur gear assembly driven by the belt, the pivotable door arm being attached to the spur gear assembly;

a rack and pinion gear connected to the gear assembly, the rack being moveable between an open position and a closed position; and a compression spring biasing the rack to the closed position, the pulley and belt drive being positioned alongside the motor, the motor being positioned between the transmission and the spur gear assembly and the motor being positioned adjacent and above the compression spring.

7. The door operator according to claim 6, further comprising:

a housing, the motor and gear assembly being positioned proximate a first end of the housing; and an electronics control module positioned adjacent the motor and gear assembly and being positioned proximate a second end of the housing, the attachment of the pivotable door arm being positioned equidistant from the first and second ends of the housing.

8. A door operator for a swing door, the door operator comprising:

a pivotable door arm adapted to be attached to the swing door;

a motor;

a gear assembly comprising a worm gear transmission connected to the motor;

a pulley and belt drive connected to the transmission;

a spur gear assembly driven by the belt, the pivotable door arm being attached to the spur gear assembly;

a rack and pinion gear connected to the gear assembly, the rack being moveable between an open position and a closed position;

a compression spring biasing the rack to the closed position;

a housing, the motor and gear assembly being positioned proximate a first end of the housing; and an electronics control module positioned adjacent the motor and gear assembly and being positioned proximate a second end of the housing, the pivotable door arm attachment to the spur gear assembly being positioned equidistant from the first and second ends of the housing, the pulley and drive belt being positioned alongside the motor, the motor being positioned between the transmission and the spur gear assembly and the motor being positioned adjacent and above the compression spring.

* * * * *